US007125181B2

(12) United States Patent
Takabatake et al.

(10) Patent No.: US 7,125,181 B2
(45) Date of Patent: Oct. 24, 2006

(54) PORTABLE PRINTER DEVICE HAVING A PLURALITY OF PAPER ROLLS

(75) Inventors: Yoshinari Takabatake, Shinagawa (JP); Sumio Watanabe, Shinagawa (JP); Fumio Sakurai, Shinagawa (JP); Yukihiro Mori, Shinagawa (JP); Toshiyuki Kobayashi, Inagi (JP)

(73) Assignee: Fujitsu Component Limited, Tokyo (JP)

( * ) Notice: Subject to any disclaimer, the term of this patent is extended or adjusted under 35 U.S.C. 154(b) by 165 days.

(21) Appl. No.: 10/913,338

(22) Filed: Aug. 9, 2004

(65) Prior Publication Data

US 2005/0207813 A1 Sep. 22, 2005

(30) Foreign Application Priority Data

Mar. 18, 2004 (JP) ..... 2004-078772

(51) Int. Cl.
*B41J 15/18* (2006.01)
*B41J 15/00* (2006.01)

(52) U.S. Cl. ..... 400/605; 400/609; 400/693; 400/88; 346/136; 358/296

(58) Field of Classification Search ..... 400/605, 400/607, 607.2, 609, 691, 693, 88, 613, 611, 400/615; 346/136; 358/296
See application file for complete search history.

(56) References Cited

U.S. PATENT DOCUMENTS 4,849,824 A * 7/1989 Sakuragi et al. ..... 358/296
4,868,674 A * 9/1989 Nakamura et al. ..... 358/296
4,963,988 A * 10/1990 Baba ..... 358/296
5,268,766 A * 12/1993 Nakadai et al. ..... 358/296

FOREIGN PATENT DOCUMENTS

| | | | |
|---|---|---|---|
| JP | 04-348971 | * 12/1992 | ..... 400/605 |
| JP | 10-235942 | 9/1998 | |
| JP | 10-235957 | 9/1998 | |
| JP | 11-048187 | 2/1999 | |

* cited by examiner

*Primary Examiner*—Leslie J. Evanisko
(74) *Attorney, Agent, or Firm*—Staas & Hasley LLP

(57) ABSTRACT

A portable printer device is capable of holding a plurality of paper rolls. The portable printer device comprises a single printing portion which is provided for printing of each of the plurality of paper rolls. A paper roll hold device includes a plurality of paper roll hold portions each of which holds one of the plurality of paper rolls, and includes a plurality of paper passages each of which is provided to deliver a paper from one of the plurality of paper roll hold portions to the printing portion.

7 Claims, 17 Drawing Sheets

PORTABLE PRINTER DEVICE HAVING A PLURALITY OF PAPER ROLLS

CROSS-REFERENCE TO RELATED APPLICATIONS

This application is based upon and claims the benefit of priority from the prior Japanese application No. 2004-078772, filed on Mar. 18, 2004, the entire contents of which are incorporated herein by reference.

BACKGROUND OF THE INVENTION

1. Field of the Invention

The present invention generally relates to a portable thermal printer device, and more particularly to a portable thermal printer device which uses the heat-sensitive paper roll.

2. Description of the Related Art

FIG. 1A and FIG. 1B show the conventional portable thermal printer device 10. The thermal printer device 10 comprises a single printing portion 11, and a heat-sensitive paper roll hold portion 15 which is capable of holding a single heat-sensitive paper roll 20.

The printing portion 11 includes the thermal head 12 and the platen roller 13. The heat-sensitive paper roll hold portion 15 is covered with the rotatable open/close lid 16. The platen roller 13 is attached to the edge of the open/close lid 16 which closes the heat-sensitive paper roll hold portion 15.

By opening the lid 16, the heat-sensitive paper roll 20 is placed in the heat-sensitive paper roll hold portion 15. By pulling out the heat-sensitive paper 21 from the heat-sensitive paper roll 20 to the position exceeding the platen roller 13, and by closing the lid 16, the heat-sensitive paper 21 is pressed against the thermal head 12 with the platen roller 13, so that the portable thermal printer device 10 is in the usable state.

For example, such portable thermal printer devices are known from Japanese Laid-Open Patent Application No. 10-235942 and Japanese Laid-Open Patent Application No. 10-235957. Japanese Laid-Open Patent Application No. 11-048187 discloses a method and device for forming an intermittent cut line in order to prevent the disconnection of cutting-plane lines due to tearing of the sheet when the load to cut it is large.

The above-mentioned portable thermal printer device 10 may be used outdoors in the field of printing out the cut-form etc.

In the field of printing out the cut-form etc., the cut-forms of different kinds being printed out may vary depending on the customers, or the labels may be printed out instead of the cut-forms.

When the conventional portable thermal printer device 10 is used, the operator must carry the heat-sensitive paper rolls of some different kinds put into the pocket etc. and must replace the heat-sensitive paper roll in the portable thermal printer device 10 with another, which is separate from that of the portable thermal printer device 10, every time the cut-form being printed differs.

In order to replace the heat-sensitive paper roll, it is necessary that the lid 16 be opened, the heat-sensitive paper roll 20 be taken out, another heat-sensitive paper roll be taken out from the pocket, the new roll be placed in the heat-sensitive paper roll hold portion 15, the heat-sensitive paper be pulled out from the heat-sensitive paper roll to the position exceeding the platen roller 13, and the lid 16 be closed. Such operations are troublesome for the operator. Moreover, there is also the problem in that the operator must carry the heat-sensitive paper rolls of some different kinds.

Moreover, the thermal printer device disclosed in Japanese Laid-Open Patent Application No. 10-235942 is configured to include the two printing portions and the two heat-sensitive paper roll hold portions, respectively. In this printer device, the problem that the operator must carry the heat-sensitive paper rolls of some different kinds will be reduced to some extent.

However, the size of the thermal printer device becomes large and the cost of the thermal printer device becomes high. If the size becomes large, it is difficult for the operator to carry the thermal printer device and operate the same.

SUMMARY OF THE INVENTION

An object of the present invention is to provide an improved portable printer device in which the above-mentioned problems are eliminated.

Another object of the present invention is to provide a portable printer device which is provided with a common printing portion and is capable of printing out the paper roll of a first kind and the paper roll of a second kind with the common printing portion.

The above-mentioned objects of the present invention are achieved by a portable printer device in which a plurality of paper rolls are held, the portable printer device comprising: a single printing portion provided for printing of each of the plurality of paper rolls; and a paper roll hold device including a plurality of paper roll hold portions each holding one of the plurality of paper rolls, and including a plurality of paper passages each provided to deliver a paper from one of the plurality of paper roll hold portions to the printing portion.

The above-mentioned objects of the present invention are achieved by a portable printer device in which a plurality of paper rolls are held, the portable printer device comprising: a body in which a single printing portion and a plurality of paper roll hold portions are provided, the single printing portion provided for printing of each of the plurality of paper rolls, each of the plurality of paper roll hold portions holding one of the plurality of paper rolls; and a plurality of covers supported on the body so that the plurality of covers are rotatable independently, the plurality of covers being provided so that the plurality of covers are opened separately and closed in an overlapped manner, all the plurality of paper roll hold portions being enclosed in the plurality of covers when all the plurality of covers are closed, wherein a plurality of paper passages are provided in respective spaces between the plurality of covers, each paper passage being provided to deliver a paper from one of the plurality of paper roll hold portions to the printing portion, and the plurality of covers are opened separately such that a predetermined one of the plurality of paper roll hold portions is selectively opened.

The above-mentioned objects of the present invention are achieved by a portable printer device in which a plurality of paper rolls are held, the portable printer device comprising: a body in which a single printing portion and a first paper roll hold portion are provided, the single printing portion provided for printing of each of the plurality of paper rolls, the first paper roll hold portion holding one of the plurality of paper rolls; and a plurality of covers supported on the body so that the plurality of covers are independently rotatable around a common shaft on the body, the plurality of covers being provided so that the plurality of covers are opened separately and closed in an overlapped manner, wherein the first paper roll hold portion is enclosed in the plurality of covers when an innermost one of the plurality of covers is closed, others of the plurality of covers being provided so that a second paper roll hold portion between the other covers and a paper passage are provided when the other covers are closed in the overlapped manner, the paper passage provided to deliver a paper from the second paper roll hold portion to the printing portion, and the second paper roll hold portion being opened when the other covers are separated from each other.

In the portable printer device of the present invention, the paper rolls of different kinds are held in the respective paper roll hold portions, and the state in which the printing of a paper from one of the paper rolls is possible can be changed, by easy operation, to the state in which the printing of a paper from another paper roll is possible. Moreover, according to the present invention, the single printing portion is provided for printing of each of the plurality of paper rolls, and it is possible to provide the portable printer device with a small size.

BRIEF DESCRIPTION OF THE DRAWINGS

Other objects, features and advantages of the present invention will be apparent from the following detailed description when read in conjunction with the accompanying drawings.

FIG. 7A, FIG. 7B and FIG. 7C are diagrams for explaining the process to change the heat-sensitive paper roll of the first kind to the heat-sensitive paper roll of the second kind for printing.

FIG. 8A, FIG. 8B, FIG. 8C and FIG. 8D are diagrams for explaining the process to change the heat-sensitive paper roll of the second kind to the heat-sensitive paper roll of the first kind for printing.

DETAILED DESCRIPTION OF PREFERRED EMBODIMENTS

A description will now be given of the first preferred embodiment of the present invention with reference to FIG. 2 through FIG. 8D.

Figure 1A:
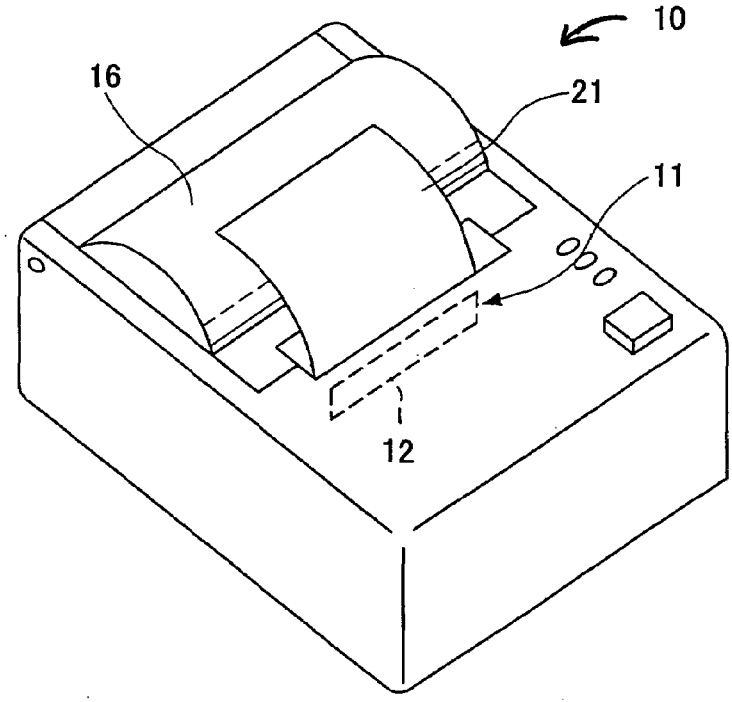
FIG.1A PRIOR ART
FIG. 1A and FIG. 1B are diagrams showing a conventional portable thermal printer device.
Figure 1B:
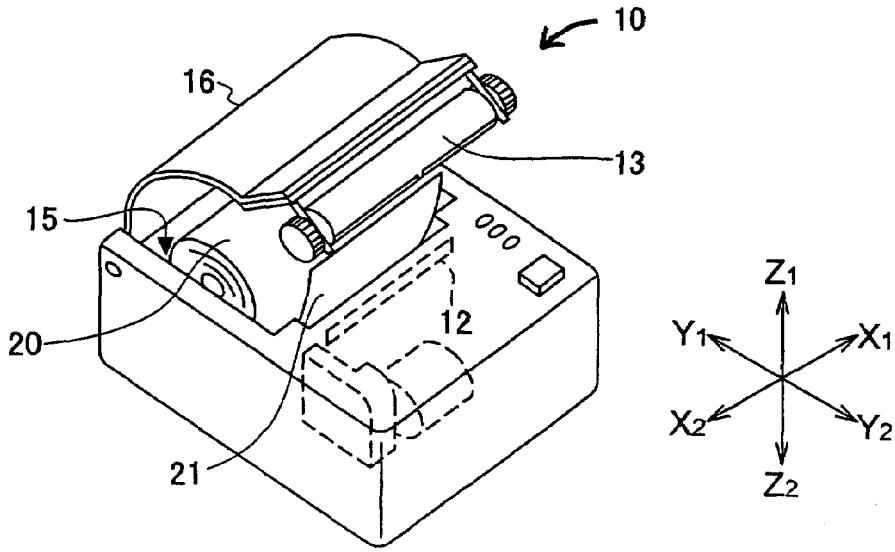
FIG.1B PRIOR ART
Figure 2:
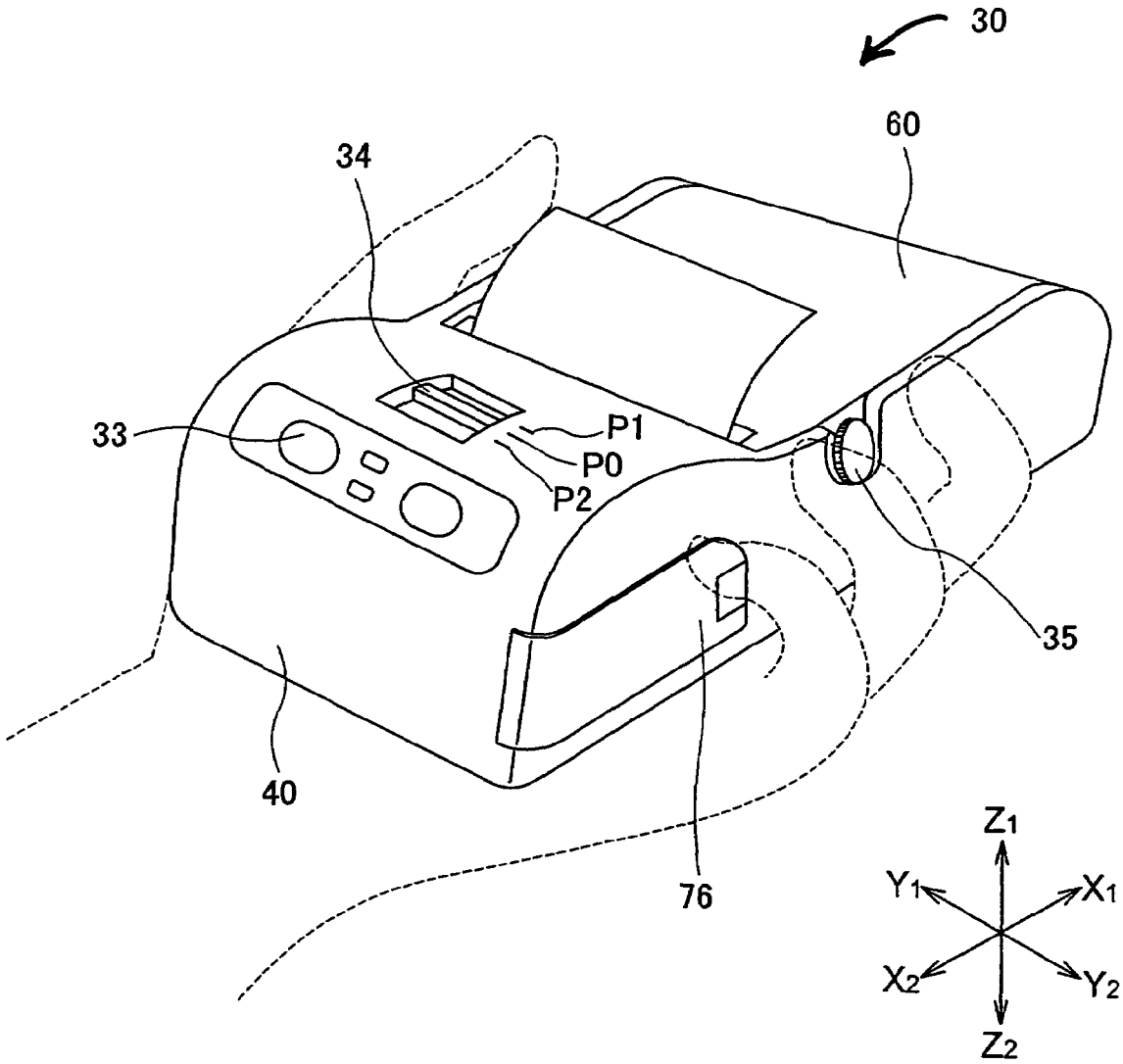
FIG. 2 is a perspective view of the portable thermal printer device in the first preferred embodiment of the invention.
Figure 3:
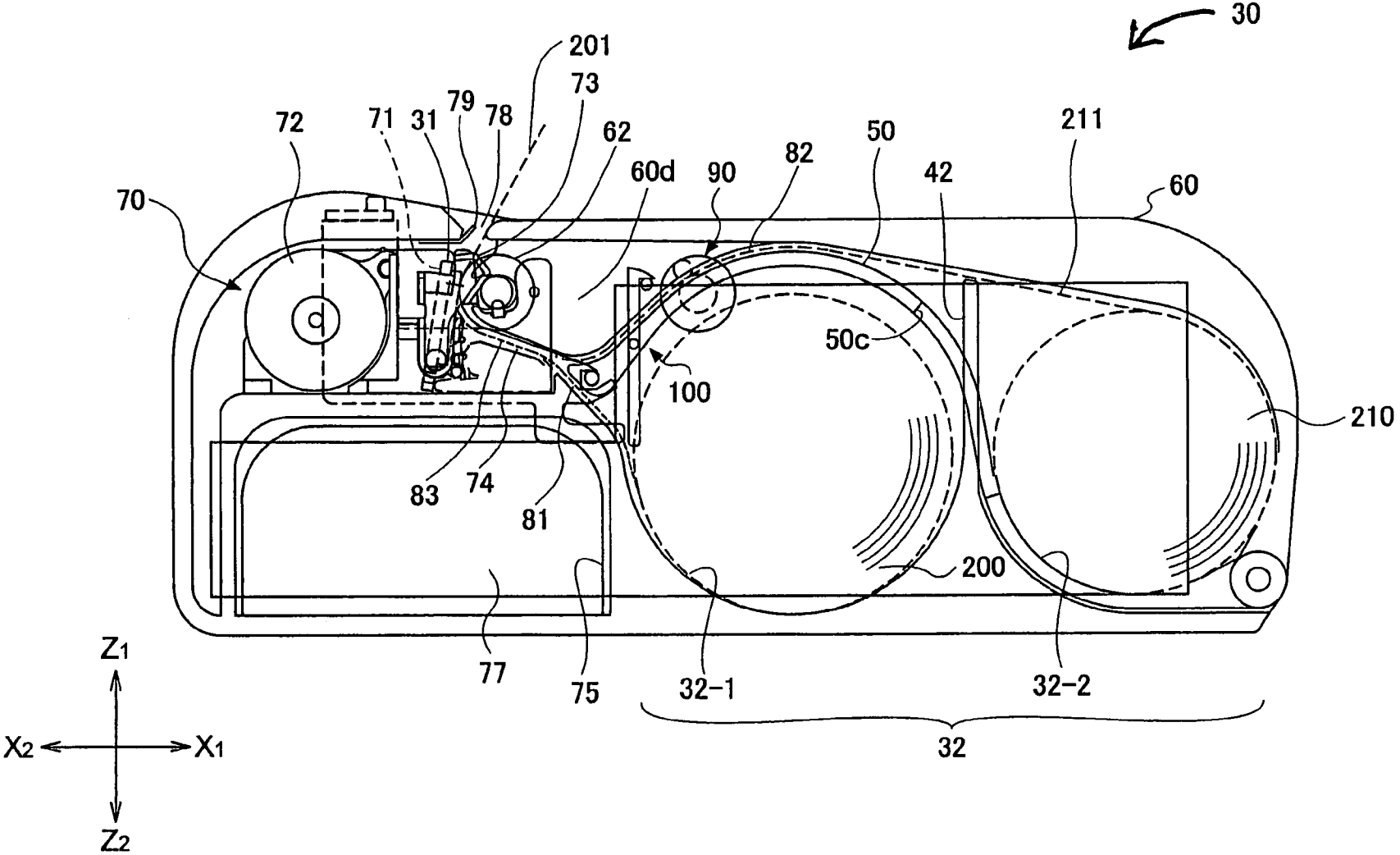
FIG. 3 is a cross-sectional view of the portable thermal printer device of FIG. 2 when the top cover and the middle cover are closed.

FIG. 2 and FIG. 3 show the portable thermal printer device 30 in the first preferred embodiment of the invention.

In the accompanying drawings, the arrows X1 and X2 indicate the length directions of the portable thermal printer device, the arrows Y1 and Y2 indicate the width directions of the portable thermal printer device, and the arrows Z1 and Z2 indicate the height directions of the portable thermal printer device. The side of X2 is the side confronting the operator when the operator holds the portable thermal printer device 30 by hand.

The portable thermal printer device 30 comprises a single printing portion 31 and a heat-sensitive paper roll hold portion 32. The printing portion 31 includes the thermal head 71 and the platen roller 62.

The heat-sensitive paper roll hold portion 32 is provided to hold the two heat-sensitive paper rolls of different kinds so that the central axes of the heat-sensitive paper rolls are arranged in parallel side by side. The heat-sensitive paper roll hold portion 32 includes the first heat-sensitive paper roll hold portion 32-1 and the second heat-sensitive paper roll hold portion 32-2.

The printing portion 31 is provided in common for the printing operation to print the heat-sensitive paper 201 from the heat-sensitive paper roll 200 of the first kind in the first heat-sensitive paper roll hold portion 32-1, and the printing operation to print the heat-sensitive paper 211 from the heat-sensitive paper roll 210 of the second kind in the second heat-sensitive paper roll hold portion 32-2.

The operation buttons 33 for starting the printing operation and other operations and the slide operation knob 34 for opening the covers are arranged on the X2 side of the printer device 30. The operation knob 34 is normally set in the P0 position. When opening only the top cover 60, the operation knob 34 is moved in the X1 direction and set in the P1 position. When opening both the middle cover 50 and the top cover 60, the operation knob 34 is further moved in the X2 direction and set in the P2 position. The operation knob 35 which is provided for pulling back the paper roll is arranged on the side surface located on the side of Y2.

The portable thermal printer device 30 includes the box-like body 40 extending in the X1 or X2 direction, the middle cover 50, and the top cover 60 in appearance.

Figure 4:
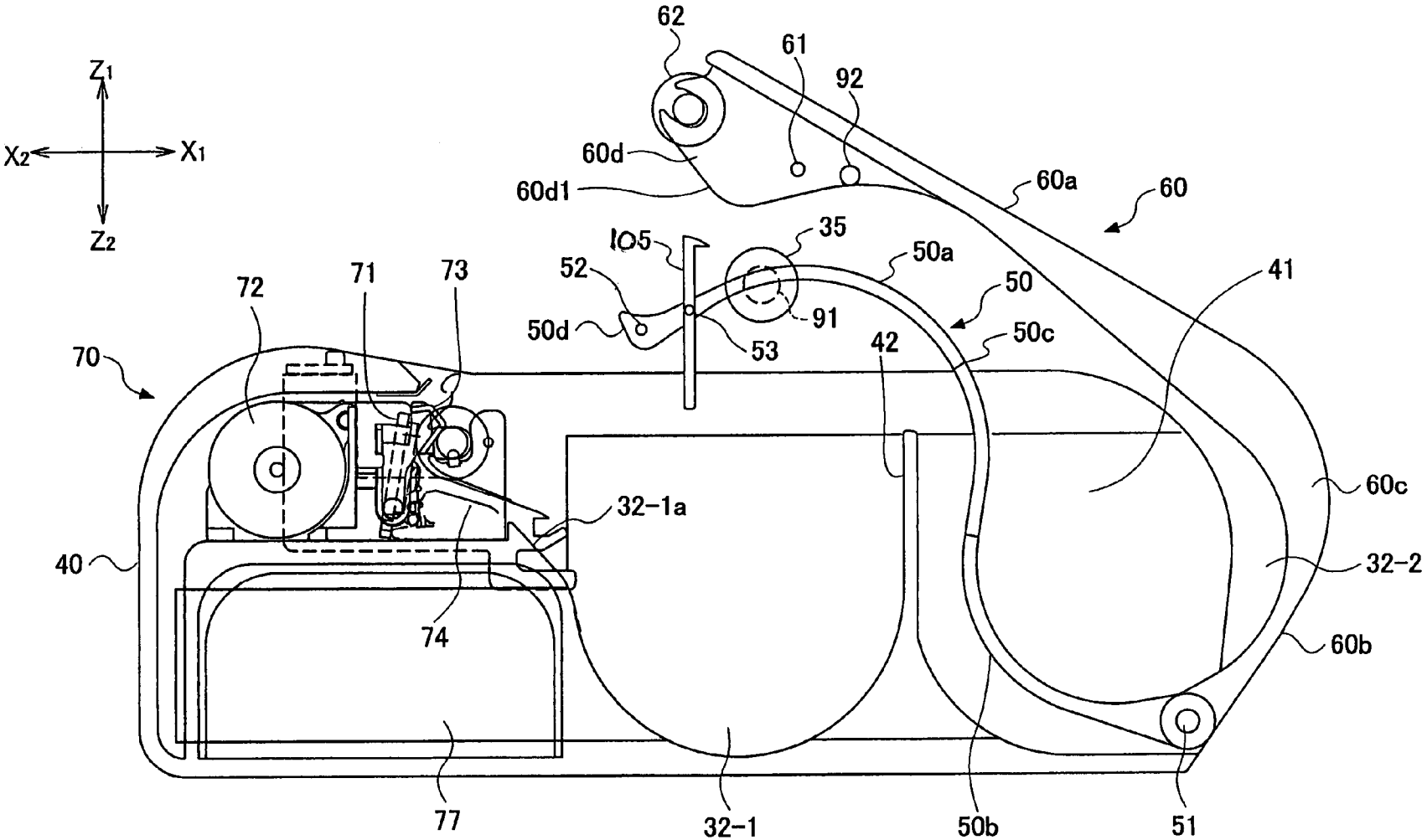
FIG. 4 is a cross-sectional view of the portable thermal printer device of FIG. 2 when the top cover and the middle cover are opened.

FIG. 4 shows the portable thermal printer device 30 of FIG. 3 when the top cover 60 and the middle cover 50 are opened.

In the portable thermal printer device 30, the middle cover 50 and the top cover 60 are arranged so that these covers are supported rotatably around the common shaft 51 which is located at the X1-side, Z2-end portion of the body 40. As shown in FIG. 4, the middle cover 50 and the top cover 60 are rotated in the same direction (clockwise rotation) and opened. On the other hand, the middle cover 50 and the top cover 60 are overlapped and closed. Moreover, the middle cover 50 and the top cover 60 are arranged so that these covers can be rotated separately.

As shown in FIG. 4, the thermal printer assembly 70 is attached to the X2-side, Z1-end portion of the body 40. The thermal printer assembly 70 is mainly comprised of the thermal head 71, the motor 72 for driving the platen roller 62, the hook 73 for locking the platen roller 62, and the roll-sheet guide plate portion 74.

The dc-battery hold portion 75 with door 76 is provided on the bottom of the thermal printer assembly 70, and the dc-battery 77 is held in the dc-battery portion 75. A single roll-sheet outlet 78 is arranged, and the cutting edge 79 is fixed to the portion of the body 40 where the roll-sheet outlet 78 is arranged.

The first heat-sensitive paper roll hold portion 32-1 having the cross section of a generally semi-circular configuration is provided in the body 40 at the position adjacent to the X1 side end of the dc-battery hold portion 75, and the hold portion 41 having the cross section of a generally quarter-circular configuration is provided at the position adjacent to the X1-side end of the first heat-sensitive paper roll hold portion 32-1.

The hold portion 41 is provided for holding the second heat-sensitive paper roll hold portion 32-2 which will be described later.

The upright wall 42 is provided at the X2-side end of the hold portion 41. The upright wall 42 serves to support the heat-sensitive paper 211 extending in the X2 direction from the heat-sensitive paper roll 210 of the second kind, and prevent the hanging down of the heat-sensitive paper 211 in the Z2 direction. Also the upright wall 42 serves as a stopper which prevents the heat-sensitive paper roll (which is held in the second heat-sensitive paper roll hold portion 32-2) from being moved unnecessarily by the pulling in the X2 direction when the second heat-sensitive paper roll becomes small and light.

The second heat-sensitive paper roll hold portion 32-2 is provided between the top cover 60 and the middle cover 50. When the top cover 60 and the middle cover 50 are closed, second heat-sensitive paper roll hold portion 32-2 is moved with the top cover 60 so that the hold portion 32-2 is settled in the hold portion 41.

As shown in FIG. 3 and FIG. 4, the top cover 60 has a generally L-shaped configuration. The top cover 60 includes the vertical plate portion 60*a*, the horizontal plate portion 60*b*, the half-cylindrical portion 60*c* between the portions 60*a* and 60*b*, and the overhanging portion 60*d* on the undersurface of the leading edge of the horizontal plate portion 60*b*. The platen roller 62 is supported at the overhanging portion 60*d* of the top cover 60.

The middle cover 50 has a generally inverted-S-shaped configuration. The middle cover 50 includes the half-cylindrical portion 50*a* which is convex in the Z1 direction, and the half-cylindrical portion 50*b* which is convex in the Z2 direction. The half-cylindrical portion 50*a* covers the top of the first heat-sensitive paper roll hold portion 32-1.

The second heat-sensitive paper roll hold portion 32-2 is formed by the space between the half-cylindrical portion 50*b* of the middle cover 50 and the half-cylindrical portion 60*c* of the top cover 60.

When the middle cover 50 and the top cover 60 are separated from each other, the second heat-sensitive paper roll hold portion 32-2 is opened. The middle cover 50 includes the opening 50*c* (refer to FIG. 5) which is located between the half-cylindrical portion 50*a* and the half-cylindrical portion 50*b*, and this opening 50*c* is fitted to the upright wall 42, so that the middle cover 50 can be closed without interfering with the upright wall 42.

When the middle cover 50 is closed, the leading edge 50*d* of the middle cover 50 approaches the slanting portion 32-1*a* on the X2-side of the first heat-sensitive paper roll hold portion 32-1, so that the first roll-sheet passage 81 is formed.

Moreover, the undersurface 60*d*1 of the overhang portion 60*d* of the top cover 60 has the configuration that corresponds to that of the half-cylindrical portion 50*a* of the middle cover 50 and the roll-sheet guide plate portion 74.

When the top cover 60 is closed, the overhang portion 60*d* approaches the half-cylindrical portion 50*a* and the roll-sheet guide plate portion 74. Hence, the second roll-sheet passage 82 is formed between the overhang portion 60*d* and the half-cylindrical portion 50*a*.

Since the top cover 60 and the middle cover 50 are supported in common by the shaft 51, even in the state in which the top cover 60 and the middle cover 50 are rotated integrally, the second roll-sheet passage 82 remains unclosed as shown in FIG. 7A.

Moreover, the third roll-sheet passage 83 is formed between the overhang portion 60*d* and the roll-sheet guide plate portion 74. The third roll-sheet passage 83 is extending generally in the X1 direction from the position where the platen roller 62 contacts the thermal head 71.

The second roll-sheet passage 82 is extending from the end of the third roll-sheet passage 83 toward the second heat-sensitive paper roll hold portion 32-2 through the upper part of the upright wall 42 and through the upper part of the first heat-sensitive paper roll hold portion 32-1.

The first roll-sheet passage 81 is formed between the third roll-sheet passage 83 and the first heat-sensitive paper roll hold portion 32-1.

The first, the second and the third roll-sheet passages 81, 82 and 83 are arranged so that the first roll-sheet passage 81 extends from the lower part of the third roll-sheet passage 83 in the slantingly upward direction, and the second roll-sheet passage 82 extends from the upper part of the third roll-sheet passage 83 in the slantingly downward direction.

Figure 5:
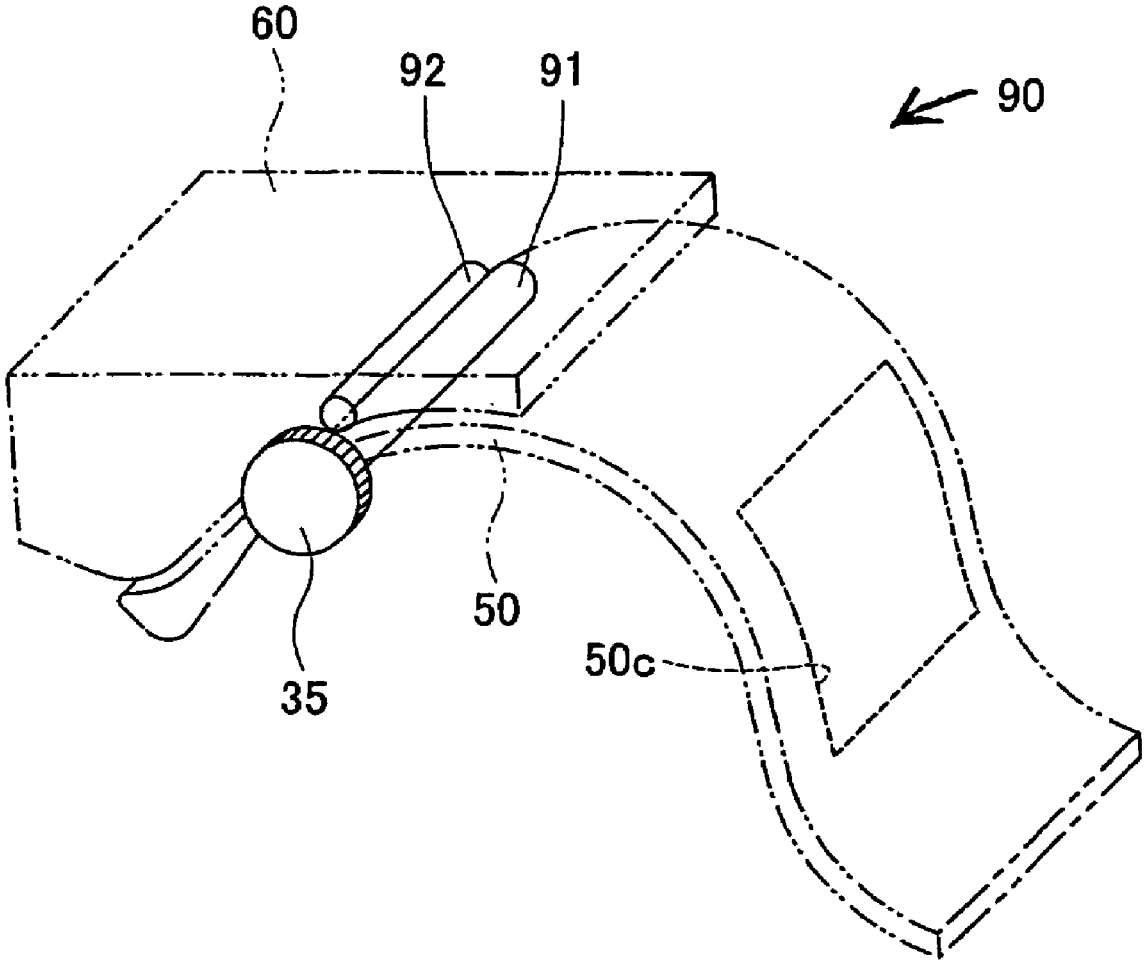
FIG. 5 is a diagram for explaining the composition of the paper-roll pull-back device.

The paper roll pull-back device 90 is provided in the middle of the second roll-sheet passage 82. As shown in FIG. 5, the paper-roll pull-back device 90 includes the drive roller 91 which is arranged across the middle cover 50 and supported thereon, and the pinch roller 92 which is arranged across the top cover 60 and supported thereon.

The operation knob 35 is secured to the end of the drive roller 91. The heat-sensitive paper 211 is sandwiched between the drive roller 91 and the pinch roller 92.

Figure 6A:
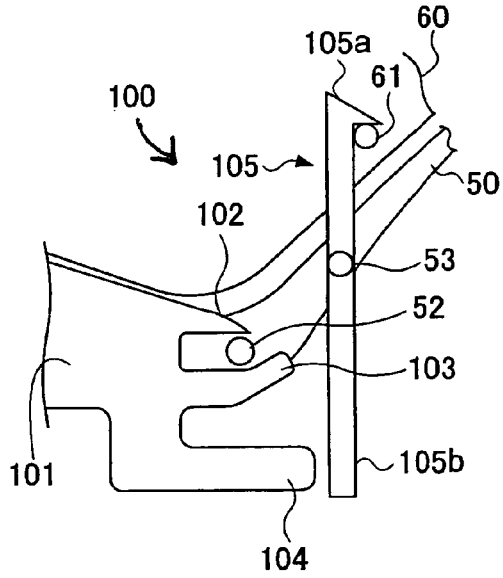
FIG. 6A, FIG. 6B and FIG. 6C are diagrams for explaining the composition of the lock device.

As shown in FIG. 6A, the lock device 100 is provided in association with the slide operation knob 34.

At the end portion of the lever 101 prolonged in the L-shaped configuration from the operation knob 34, the hook portion 102, the cam portion 103, and the push portion 104 are provided in the Z1-to-Z2 direction.

The hook portion 102 is provided to be connected with the pin 52 at one end of the middle cover 50. The cam portion 103 is projecting over the hook portion 102 in the X1 direction and extending in the slantingly upward direction. When moved in the X2 direction, the cam portion 103 pushes up the pin 52 in the Z2 direction.

The push portion 104 is prolonged in the X1 direction over the cam portion 103. The slender hook member 105 is supported in the middle of the hook member 105 by the pin 53 on the middle cover 50, and the hook portion 105*a* at the Z1-side end thereof is provided to be connected with the pin 61 on the top cover 60.

In the state in which both the middle cover 50 and the top cover 60 are closed and the operation knob 34 is located in the position P0, the push portion 104 is countered against the portion 105*b* of the hook portion 105 at the Z2-side end of the hook portion 105.

Figure 6B:
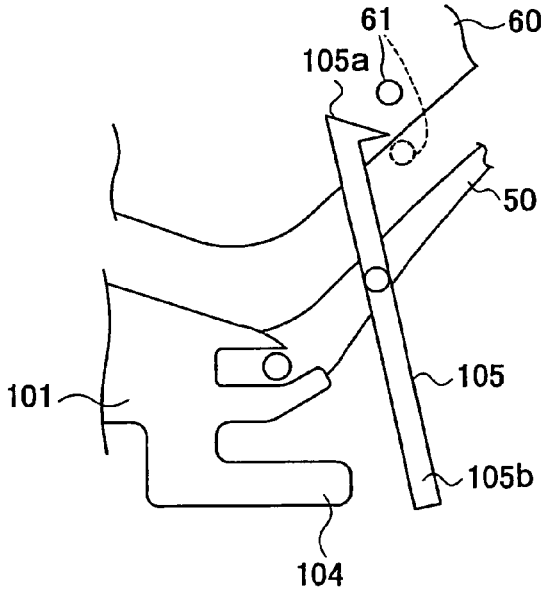

When the slide operation knob 34 is set to P1 in the X1 direction, the hook member 105 is pushed by the push portion 104 and rotated around the pin 53, and the connection of the hook portion 105*a* and the pin 61 is canceled, as shown in FIG. 6B, so that only the top cover 60 is opened.

Figure 6C:
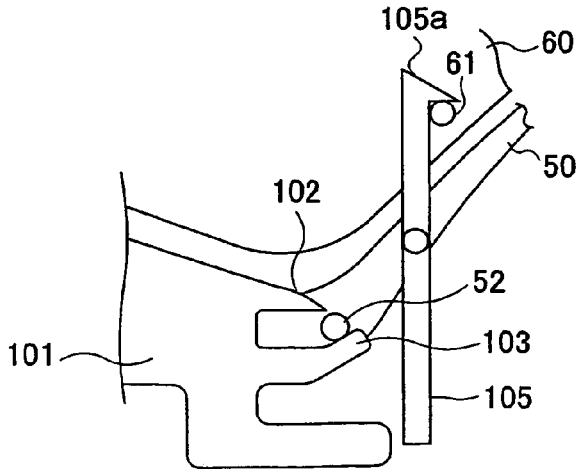

When the slide operation knob 34 is set to P2 in the X2 direction, the connection of the hook portion 102 and the pin 52 is canceled, and the pin 52 is raised by the cam portion 103, as shown in FIG. 6C, so that the middle cover 50 and the top cover 60 are combined by the hook member 105 and they are opened together in the combined state.

The heat-sensitive paper roll 200 of the first kind is held in the first heat-sensitive paper roll hold portion 32-1, the heat-sensitive paper roll 210 of the second kind is held in the second heat-sensitive paper roll hold portion 32-2, the heat-sensitive paper 201 from the heat-sensitive paper roll 200 of the first kind is pulled out by even the printing portion 31, and FIG. 3 shows the state where printing is performed to the heat-sensitive paper 201. The heat-sensitive paper roll 200 of the first kind and the heat-sensitive paper roll 210 of the second kind are held at a time in the portable thermal printer device 30.

After the printing is performed, the printed heat-sensitive paper 201 is ejected from the roll-sheet outlet 78, and cut away using the cutting edge 79.

The condition of the thermal printer device 30 shown in FIG. 3 is obtained as follows.

The top cover 60 and the middle cover 50 are opened as shown in FIG. 4. The heat-sensitive paper roll 200 of the first kind is held in the first heat-sensitive paper roll hold portion 32-1. One end of the heat-sensitive paper 201 which is the roll sheet is pulled out to the printing portion 31, and the heat-sensitive paper roll 210 of the second kind is held in the second heat-sensitive paper roll hold portion 32-2. The end of the heat-sensitive paper 211 which is the roll sheet is pulled out to the position beyond the paper roll pull-back device 90. The top cover 60 and the middle cover 50 are combined and locked by the hook member 105. The heat-sensitive paper 201 is pulled out from the heat-sensitive paper roll 200 of the first kind to the position exceeding the platen roller 62. Finally, the top cover 60 and the middle cover 50 are closed and locked by the lock device 100.

Next, the changing operation to change from the state where printing is performed to the heat-sensitive paper 201 of the first kind to the state where printing can be performed to the heat-sensitive paper 211 of the second kind will be described with reference to FIG. 7A through FIG. 7D.

First, as indicated by the arrow A in FIG. 7A, the operation knob 34 is operated in the X2 direction. By this operation, the lock device 100 is placed in the state shown in FIG. 6C, the connection of the pin 52 and the hook portion 102 is canceled, and the cam portion 103 pushes up the top cover 60 and the middle cover 50 slightly.

Subsequently, as indicated by the arrow B in FIG. 7A, the operator opens the top cover 60 and the middle cover 50 integrally, so that the upper part of the first heat-sensitive paper roll hold portion 32-1 is opened. As indicated by the arrow C in FIG. 7A, the operator returns the heat-sensitive paper 201 of the first kind which extends to the thermal head 71, and connects with the heat-sensitive paper roll 200 of the first kind.

Subsequently, the hook member 105 is operated and the connection of the top cover 60 and the middle cover 50 is canceled. As indicated by the arrow D in FIG. 7B, only the middle cover 50 is closed. By this operation, the first heat-sensitive paper roll hold portion 32-1 is closed, and the second heat-sensitive paper roll hold portion 32-2 is opened.

Subsequently, as indicated by the arrow E in FIG. 7B, the heat-sensitive paper 211 from the heat-sensitive paper roll 210 of the second kind is suited along the top surface of the middle cover 50 and the top surface of the roll-sheet guide plate portion 74, and the heat-sensitive paper 211 is pulled out to the position beyond the thermal head 71.

Finally, as indicated by the arrow F in FIG. 7C, the top cover 60 is closed.

By this operation, the portable thermal printer device 30 is placed in the state where printing is performed to the heat-sensitive paper 211 of the second kind. When the operation button 33 is operated and printing operation is performed, the platen roller 62 delivers the heat-sensitive paper 211, and the heat-sensitive paper 211 is pulled out from the heat-sensitive paper roll 210 of the second kind to the thermal head 71 through the second and third roll-sheet passages 82 and 83, so that the printing is performed to the heat-sensitive paper 211.

The printed heat-sensitive paper 211 is sent out from the roll-sheet outlet 78, and is cut away using the cutting edge 79.

Next, the changing operation to change from the state where printing is performed to the heat-sensitive paper 211 of the second kind to the state where printing can be performed with respect to the heat-sensitive paper 201 of the first kind will be described with reference to FIG. 8A through FIG. 8C.

First, as indicated by the arrow G in FIG. 8A, the operation knob 35 is rotated clockwise. By this operation, the drive roller 91 is rotated, the heat-sensitive paper 211 is moved in the X1 direction by this, and the heat-sensitive paper 211 which is extended to the position of the thermal head 71 is pulled back.

Subsequently, as indicated by the arrow H in FIG. 8A, the operation knob 34 is operated in the X2 direction, and the connection of the pin 52 and the hook portion 102 is canceled.

As indicated by the arrow I in FIG. 8B, the top cover 60 and the middle cover 50 are opened integrally, so that the upper part of the first heat-sensitive paper roll hold portion 32-1 is opened. The heat-sensitive paper 201 of the first kind is pulled out from the heat-sensitive paper roll 200 of the first kind as indicated by the arrow J, and the operator suits the heat-sensitive paper 201 to the top surface of the roll-sheet guide plate portion 74 and pulls it out to the position beyond the thermal head 71.

Moreover, if needed, as shown in FIG. 8C, the heat-sensitive paper roll 210 of the second kind is rotated from the opening 50*c* by the fingertip, as indicated by the arrow K, and the pulled-back heat-sensitive paper 211 is rolled around the heat-sensitive paper roll 210 of the second kind.

Finally, as indicated by the arrow L in FIG. 8D, the top cover 60 and the middle cover 50 which are combined are closed.

By this operation, the portable thermal printer device 30 is placed in the state where printing is performed to the heat-sensitive paper 201 of the first kind. When the operation button 33 is operated and printing operation is performed, the platen roller 62 delivers the heat-sensitive paper 201, and the heat-sensitive paper 201 is pulled out from the heat-sensitive paper roll 200 of the first kind to the thermal head 71 through the first and third roll-sheet passages 81 and 83, so that the printing is performed on the heat-sensitive paper 201.

Next, a description will be given of the second preferred embodiment of the invention.

Figure 9:
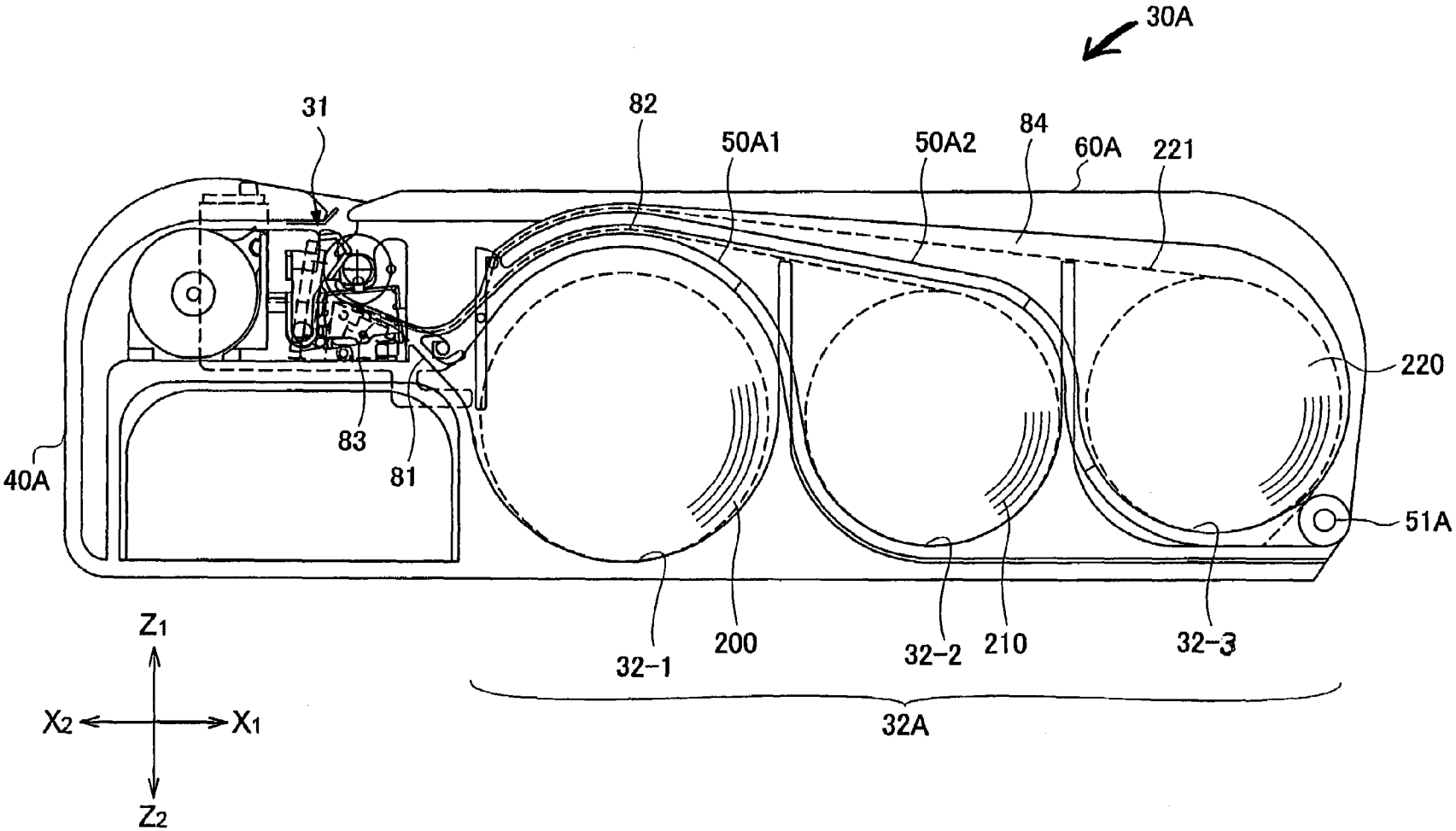
FIG. 9 is a cross-sectional view of the portable thermal printer device in the second preferred embodiment of the invention.

FIG. 9 shows the portable thermal printer device 30A in the second preferred embodiment of the invention. The portable thermal printer device 30A includes the single printing portion 31 and the heat-sensitive paper roll hold portion 32A.

The portable thermal printer device 30A includes the printing portion 31 at the X2 side portion of the body 40A which is in the elongated box-like shape extending in the direction X. The portable thermal printer device 30A is provided so that the first middle cover 50A1 having the generally S-shaped configuration, the second middle cover 50A2 having the generally S-shaped configuration, and the top cover 60A having the L-shaped configuration are supported in common to be rotatably around the shaft 51A at the X1-side end of the body 40A.

In the condition of the portable thermal printer device 30A in FIG. 9, the first middle cover 50A1, the second middle cover 50A2, and the top cover 60A are closed such that they overlap each other. The heat-sensitive paper roll hold portion 32A includes the first, the second, and the third heat-sensitive paper roll hold portions 32-1, 32-2, and 32-3.

The heat-sensitive paper rolls of the three different kinds can be arranged in and held by the heat-sensitive paper roll hold portions 32-1, 32-2 and 32-3 such that the central axes thereof are located in parallel respectively. There are provided the roll-sheet passages 81, 82, and 84 which extend to the printing portion 31 from the first, the second, the third heat-sensitive paper roll hold portions 32-1, 32-2, and 32-3.

The roll-sheet passage 84 is provided between the middle cover 50A2 and the top cover 60A.

The first, the second, and the third heat-sensitive paper rolls 200, 210, and 220 are held in the first, the second, and the third heat-sensitive paper roll hold portions 32-1, 32-2, and 32-3, respectively.

The heat-sensitive paper 221 of the third kind from the third heat-sensitive paper roll 220 is directed in the X2 direction along the roll-sheet passage 84. The operation of changing the heat-sensitive paper being printed can be carried out similarly in accordance with the operations shown in FIGS. 7A–7C and FIGS. 8A–8D.

Next, a description will be given of the third preferred embodiment of the invention.

Figure 10:
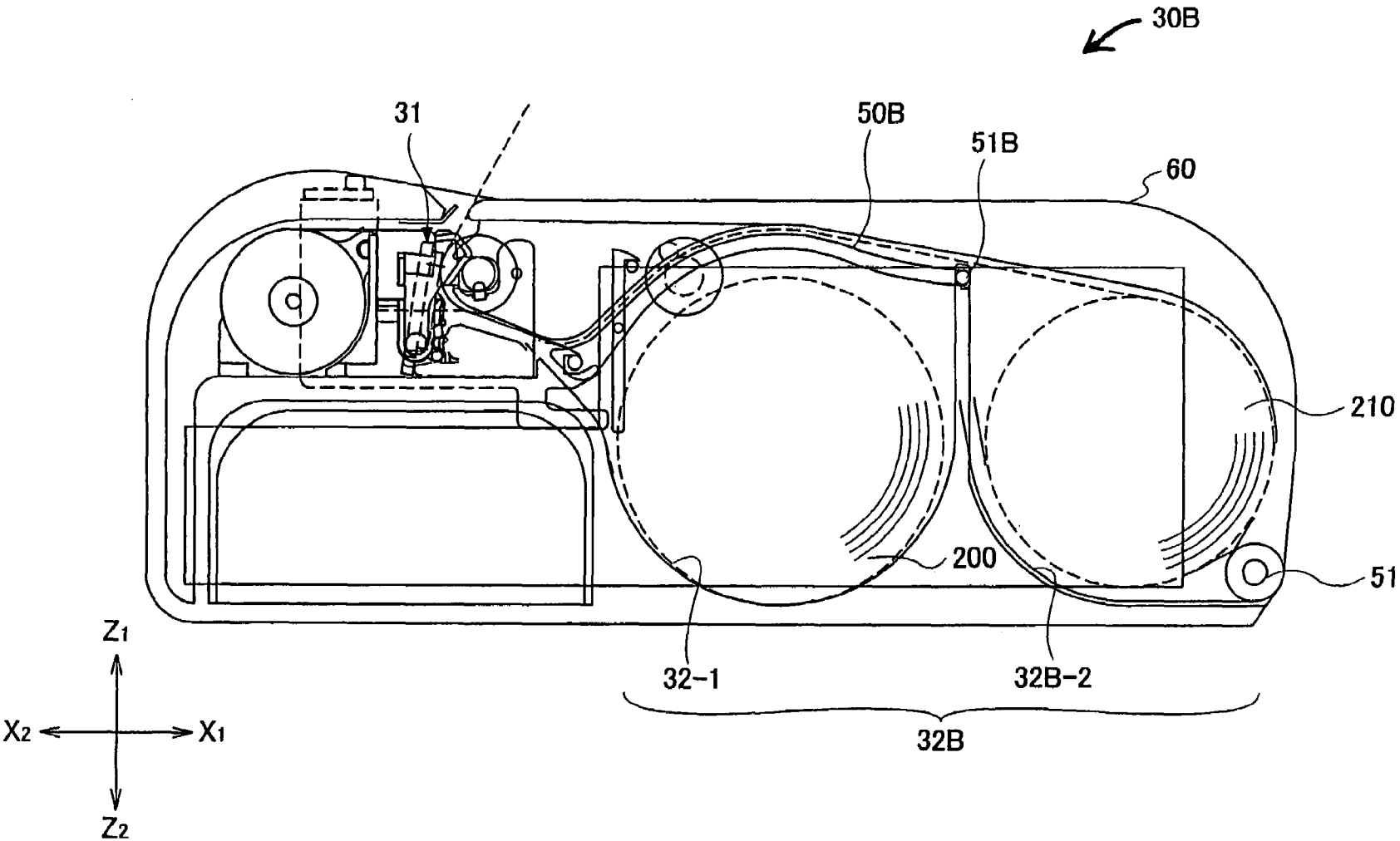
FIG. 10 is a cross-sectional view of the portable thermal printer device in the third preferred embodiment of the invention.

FIG. 10 shows the portable thermal printer device 30B in the third preferred embodiment of the invention. In the portable thermal printer device 30B of the present embodiment, the middle cover 50 in the portable thermal printer device 30 of FIG. 3 is replaced with the middle cover 50B. This middle cover 50B is supported to be rotatable around the shaft 51B provided on the upright wall 42. The portable thermal printer device 30B include the single printing portion 31 and the heat-sensitive paper roll hold portion 32B.

The sensible-heat paper roll hold portion 32B includes the first and the second heat-sensitive paper roll hold portions 32-1 and 32B-2. The top cover 60 is closed such that the top cover 60 and the middle cover 50B overlap each other. The operation of changing the heat-sensitive paper being printed can be carried out similarly in accordance with the operations shown in FIGS. 7A–7C and FIGS. 8A–8D.

Next, a description will be given of the fourth preferred embodiment of the invention.

Figure 11:
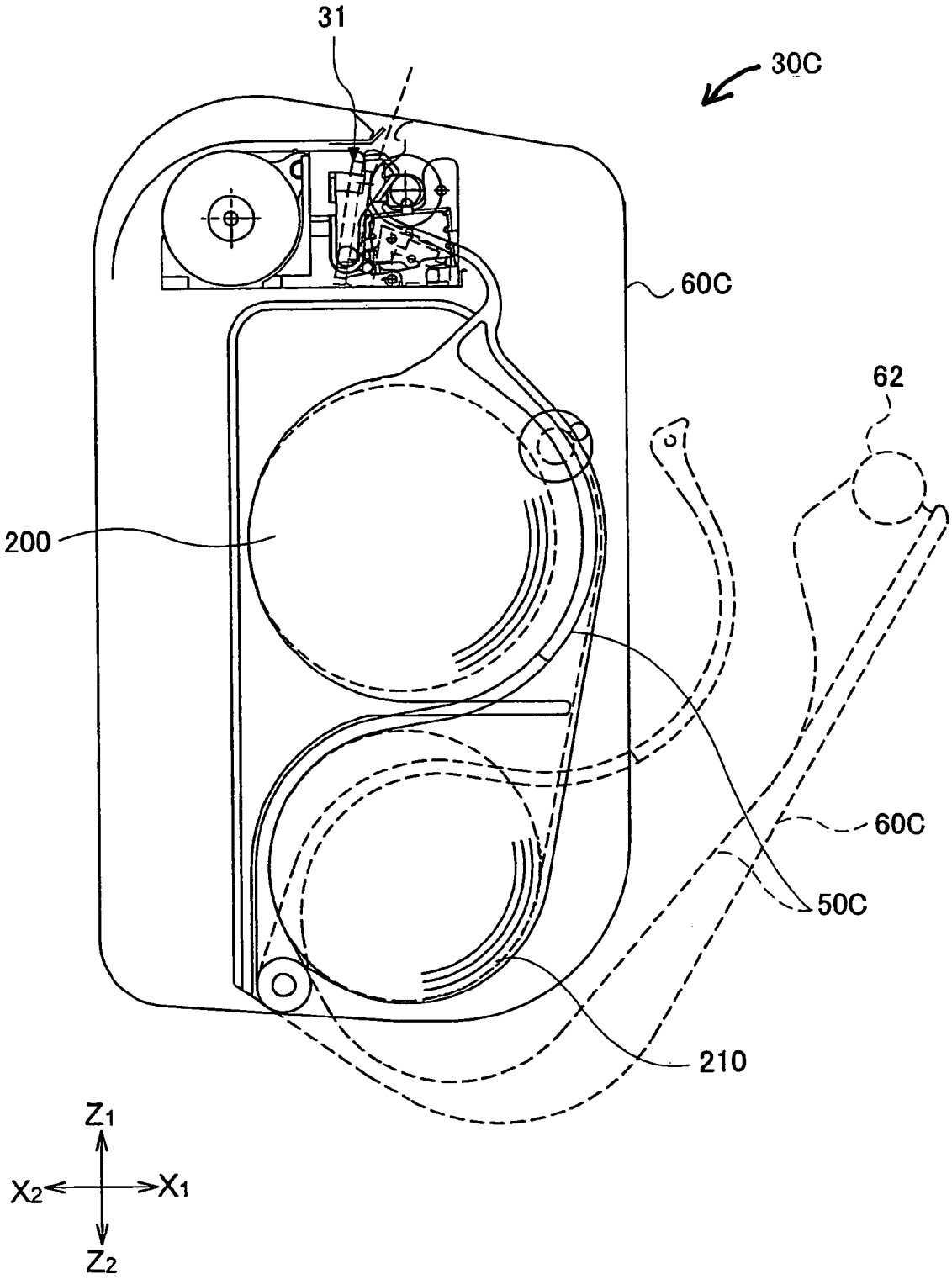
FIG. 11 is a cross-sectional view of the portable thermal printer device in the fourth preferred embodiment of the invention.

FIG. 11 shows the upright type portable thermal printer device 30C in the fourth preferred embodiment of the invention.

The portable thermal printer device 30C includes the single printing portion 31 and the heat-sensitive paper roll hold portion 32B. The heat-sensitive paper roll hold portion 32B is provided such that the first and the second heat-sensitive paper roll hold portions 32-1 and 32-2 are arranged in the direction Z.

The top-cover 60C and the middle cover 50C are supported by the body 40C to be rotatable around the shaft 51. The operation of changing the heat-sensitive paper being printed can be carried out similarly in accordance with the operations shown in FIGS. 7A–7C and FIGS. 8A–8D.

Next, a description will be given of the fifth preferred embodiment of the invention.

Figure 12:
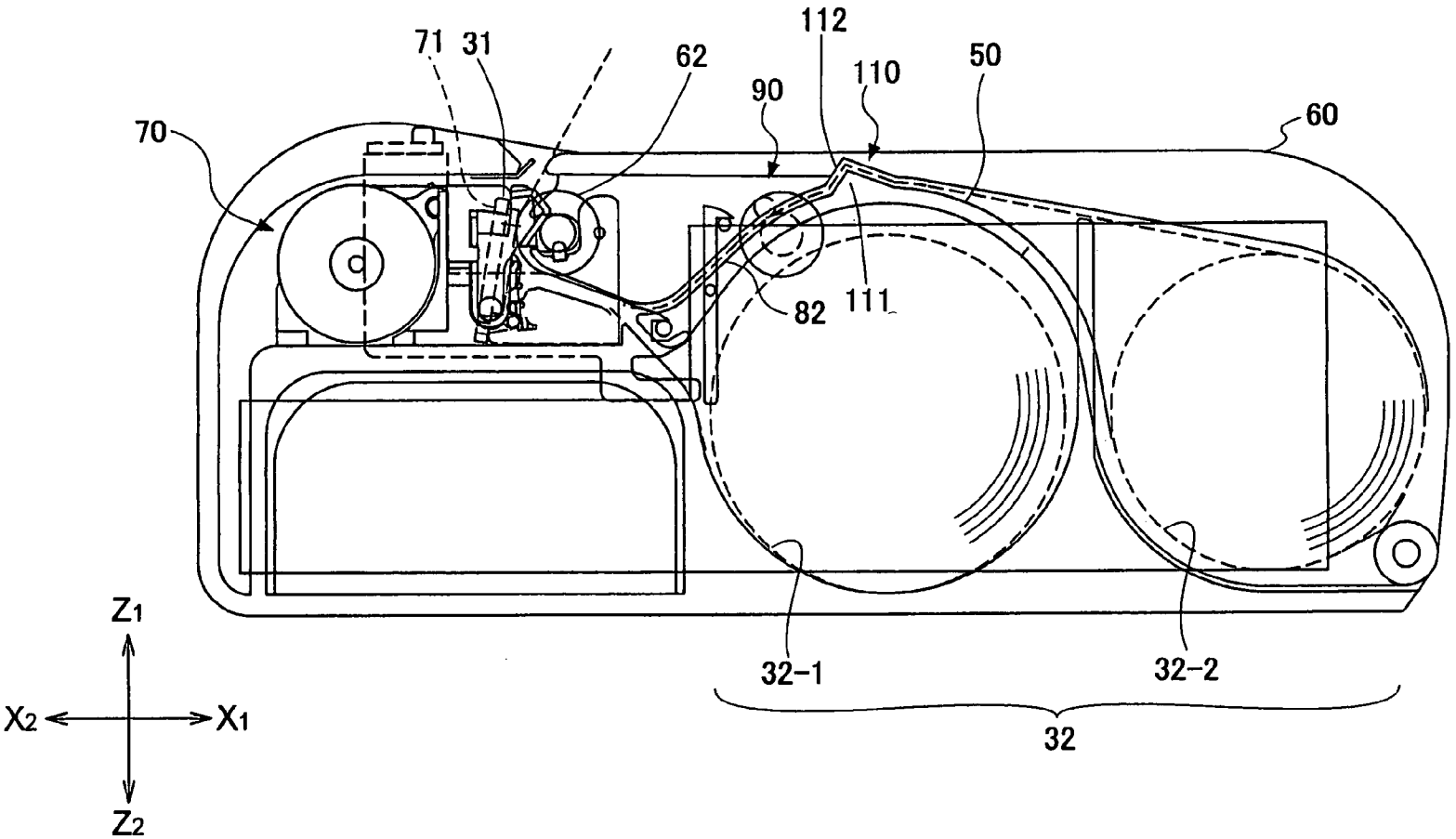
FIG. 12 is a cross-sectional view of the portable thermal printer device in the fifth preferred embodiment of the invention.

FIG. 12 shows the portable thermal printer device 30D in the fifth preferred embodiment of the invention.

As shown in FIG. 12, the portable thermal printer device 30D of the present embodiment further comprises the heat-sensitive paper hold portion 110 which holds the heat-sensitive paper by friction, in addition to the components of the portable thermal printer device 30 of FIG. 3.

The heat-sensitive paper hold portion 110 is provided at the position between the paper roll pull-back device 90 in the second roll-sheet passage 82 and the second heat-sensitive paper roll hold portion 32-2. The position of the heat-sensitive paper hold portion 110 is located slightly nearer to the second heat-sensitive paper roll hold portion 32-2 than the paper roll pull-back device 90.

The heat-sensitive paper hold portion 110 is provided so that the projection 111 having the triangular cross-section on the top surface of the middle cover 50 is fitted to the recess 112 having the triangular cross-section on the bottom surface of the top cover 60, and the heat-sensitive paper 211 is loosely interposed between the projection 111 and the recess 112 and curved into the ripple shape.

According to the elastic force of the heat-sensitive paper 211 to restore to its original shape, the heat-sensitive paper 211 contacts the surfaces of the projection 111 and the recess 112, so that the heat-sensitive paper 211 is held by friction.

Alternatively, a plurality of sets of projections and recesses each having the triangular cross-section may be provided so that the heat-sensitive paper 211 is curved into the ripple shape consecutively. In the alternative embodiment, the elastic force to hold the heat-sensitive paper 211 by the heat-sensitive paper hold portion can be increased.

Next, a description will be given of the sixth preferred embodiment of the invention.

Figure 13:
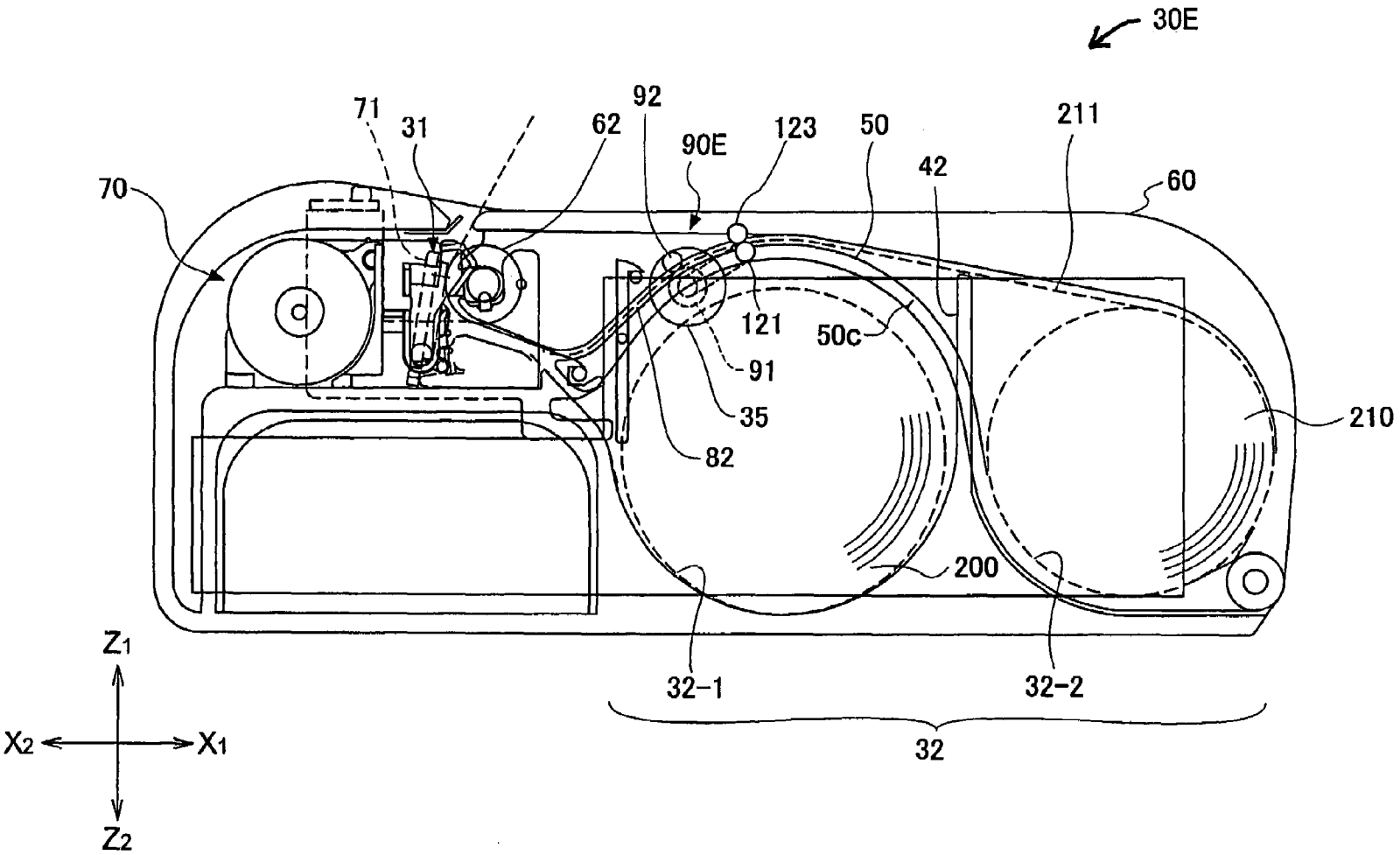
FIG. 13 is a cross-sectional view of the portable thermal printer device in the sixth preferred embodiment of the invention.

FIG. 13 shows the portable thermal printer device 30E in the sixth preferred embodiment of the invention.

As shown in FIG. 13, in the portable thermal printer device 30E of the present embodiment, the paper roll pull-back device 90 in the portable thermal printer device 30 of FIG. 3 is replaced with the paper roll pull-back/feed device 90E.

Figure 14A:
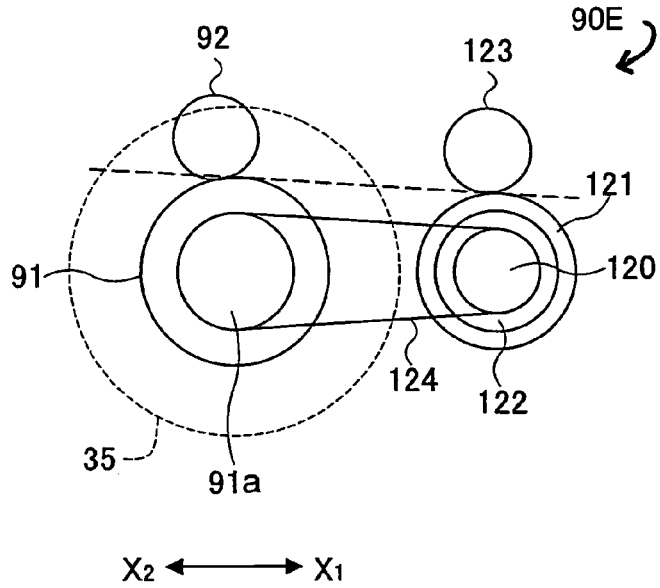
FIG. 14A, FIG. 14B and FIG. 14C are diagrams for explaining the composition of the paper-roll pull-back/feed device in the portable thermal printer device of FIG. 13.
Figure 14B:
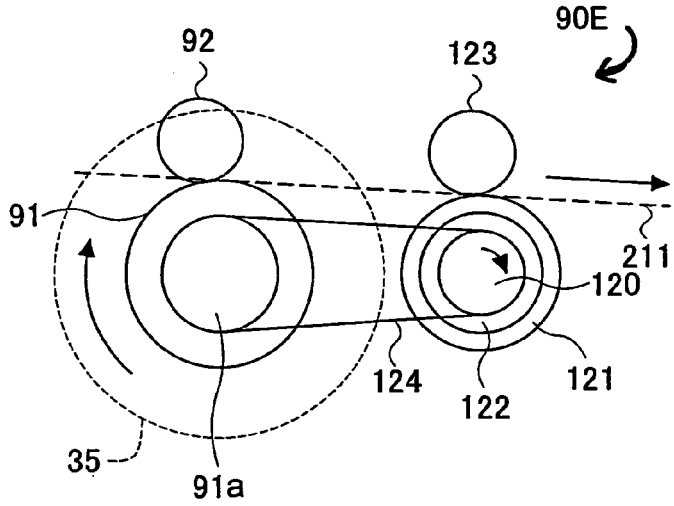
Figure 14C:
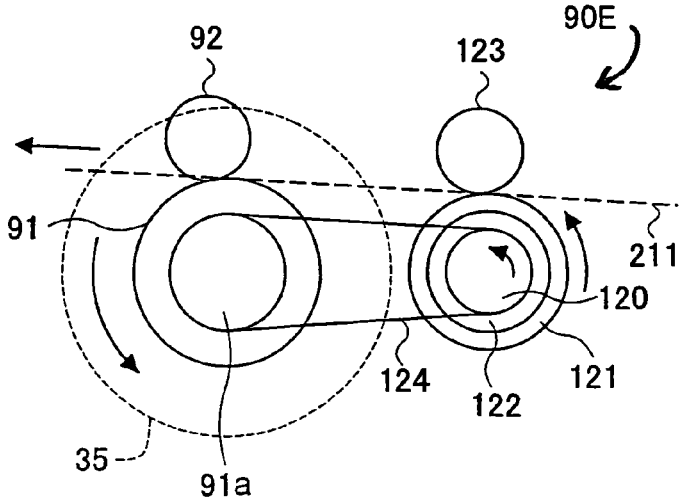

FIG. 14A, FIG. 14B and FIG. 14C are diagrams for explaining the composition of the paper roll pull-back/feed device 90E in the portable thermal printer device 30E of FIG. 13.

As shown in FIG. 14A, the paper roll pull-back/feed device 90E is provided to include the rotation shaft 120, the drive roller 121, the free wheeling clutch 122, the pinch roller 123, and the belt 124, in addition to the drive roller 91 and the pinch roller 92.

The rotation shaft 120 is supported on the middle cover 50, and the drive roller 121 is supported by the rotation shaft 120 through the free wheeling clutch 122.

The free wheeling clutch 122 is provided so that only the counterclockwise rotation of the rotation shaft 120 is transmitted to the drive roller 121, and the clockwise rotation of the rotation shaft 120 is not transmitted to the drive roller 121.

The pinch roller 123 is supported by the top cover 60, and placed in contact with the drive roller 121.

The drive roller 121 and the pinch roller 123 are provided at the position which is slightly nearer to the second heat-sensitive paper roll hold portion 32-2 than the position of the drive roller 91 and the pinch roller 92. The belt 124 is wound between the shaft portion 91*a* of the drive roller 91 and the rotation shaft 120.

As shown in FIG. 14A, when the operation knob 35 is rotated clockwise in the state where the heat-sensitive paper 211 passes through the position between the drive roller 91 and the pinch rollers 92 and through the position between the drive roller 121 and the pinch rollers 123, the heat-sensitive paper 211 is moved in the X1 direction by the drive roller 91 and the pinch-roller 92, and it will be pulled back.

As the rotation shaft 120 is rotated clockwise through the belt 124, the free wheeling clutch 122 does not transmit the rotation to the drive roller 121 and the drive roller 121 is not rotated. As shown in FIG. 14B, the heat-sensitive paper 211 is stopped at the position where the heat-sensitive paper 211 just passes through the drive roller 91. The heat-sensitive paper 211 at this time is interposed between the drive roller 121 and the pinch roller 123.

When the operation knob 35 is rotated counterclockwise in the condition of FIG. 14B, the drive roller 91 is rotated counterclockwise as shown in FIG. 14C. The rotation shaft 120 is rotated counterclockwise through the belt 124, and the drive roller 121 is rotated counterclockwise through the free wheeling clutch 122.

The heat-sensitive paper 211 is moved in the X2 direction by the drive roller 121 and the pinch roller 123, and it is further moved in the X2 direction by the drive roller 91 and the pinch-roller 92 so that the feeding of the heat-sensitive paper 211 is possible.

With the paper roll pull-back/feed device 90E provided in the portable thermal printer device 30E, the feeding of the heat-sensitive paper 211 is made possible by the operation of the operation knob 35. Therefore, it is not necessary to perform the operation of canceling the connection of the top cover 60 and the middle cover 50 and extending the space between the top cover 60 and the middle cover 60 as shown in FIG. 7B.

Therefore, it is possible for the present embodiment to more easily perform the operation of changing the heat-sensitive paper 201 of the first kind to the heat-sensitive paper 211 of the second kind as the paper being printed.

Next, a description will be given of the seventh preferred embodiment of the invention.

Figure 15:
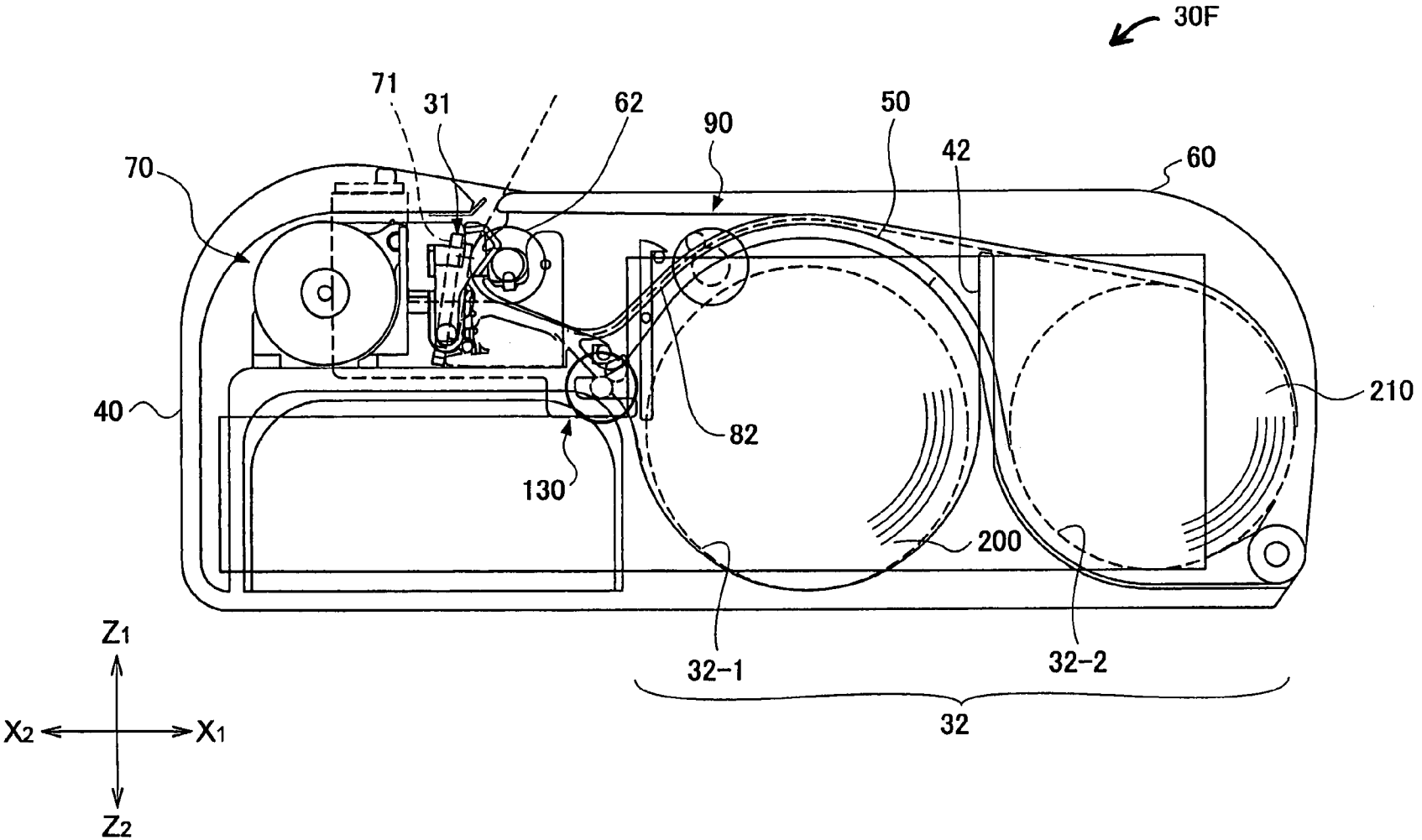
FIG. 15 is a cross-sectional view of the portable thermal printer device in the seventh preferred embodiment of the invention.

FIG. 15 shows the portable thermal printer device 30F in the seventh preferred embodiment of the invention.

As shown in FIG. 15, the portable thermal printer device 30F of the present embodiment is provided by adding the paper roll pull-back device 130 to the composition of the portable thermal printer device 30 of FIG. 3.

Figure 16:
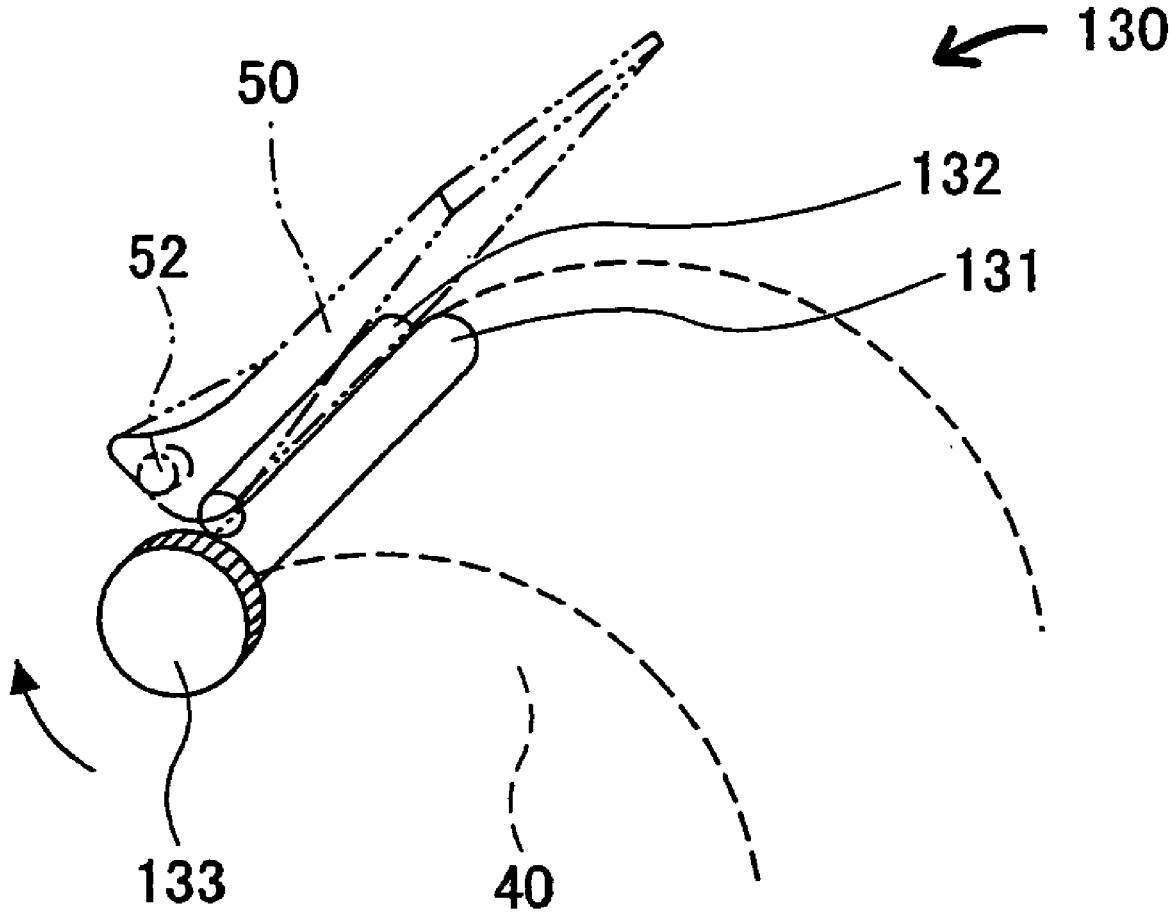
FIG. 16 is a diagram for explaining the composition of the paper-roll pull-back device in the first paper-roll passage of the portable thermal printer device of FIG. 15.

FIG. 16 is a diagram for explaining the composition of the paper roll pull-back device 130 in the first paper-roll passage of the portable thermal printer device 30F.

As shown in FIG. 16, the paper roll pull-back device 130 is provided in the first roll-sheet passage 81, and this paper roll pull-back device 130 includes the drive roller 131 supported by the body 40, and the pinch roller 132 supported at one end of the middle cover 50.

The operation knob 133 is fixed to the end of the drive roller 131. The heat-sensitive paper 201 is interposed between the drive roller 131 and the pinch roller 132.

By rotating the operation knob 133 clockwise, the heat-sensitive paper 201 which is located in the first roll-sheet passage 81 is sent toward the direction of the first heat-sensitive paper roll hold portion 32-1, so that the paper is pulled back.

With the paper roll pull-back device 130 provided in the portable thermal printer device 30F, the pulling back of the heat-sensitive paper 201 is possible by the operation of the operation knob 133.

Therefore, when changing the heat-sensitive paper being printed to the heat-sensitive paper 211 of the second kind from the heat-sensitive paper 201 of the first kind, the operation knob 133 is rotated clockwise and the heat-sensitive paper 201 is pulled back.

It is not necessary to perform the operation of opening the top cover 60 and the middle cover 50 integrally and winding the heat-sensitive paper 201 of the first kind around the heat-sensitive paper roll 200 of the first kind as shown in FIG. 7A. Therefore, the ease of operation can be improved.

Next, a description will be given of the eighth preferred embodiment of the invention.

Figure 17A:
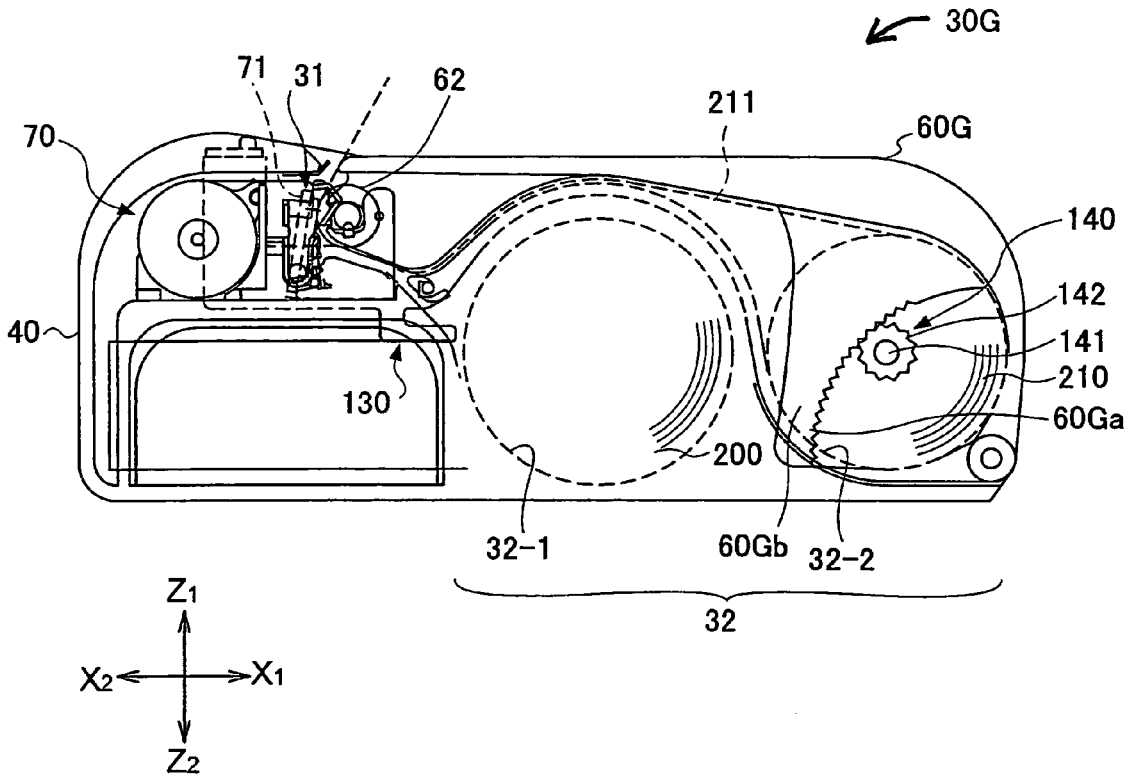
FIG. 17A and FIG. 17B are diagrams showing the portable thermal printer device in the eighth preferred embodiment of the invention.
Figure 17B:
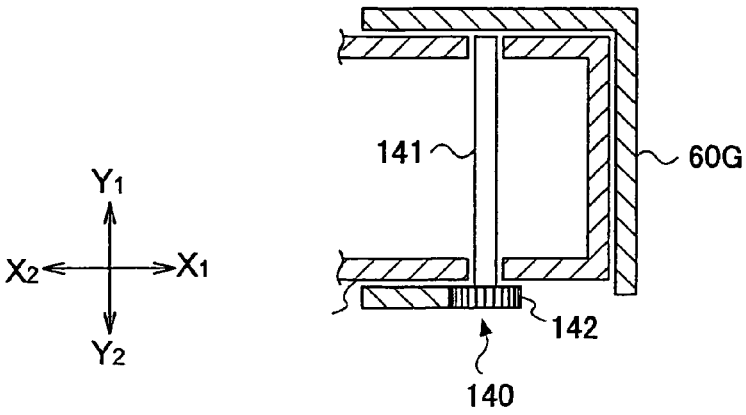

FIG. 17A and FIG. 17B show the portable thermal printer device 30G in the eighth preferred embodiment of the invention.

As shown in FIG. 17A, in the portable thermal printer device 30G of the present embodiment, the paper roll pull-back/feed device 140 which is interlocked with the opening/closing operation of the top cover 60G is provided, and the paper roll pull-back device 90 as in the portable thermal printer device 30 of FIG. 3 is omitted.

The paper roll pull-back/feed device 140 includes the reduction gear 142 at the end of the heat-sensitive paper roll support shaft 141, and the internal-gear 60Ga of the top cover 60G which is engaged with the reduction gear 142.

The heat-sensitive paper roll support shaft 141 is rotatably supported at the center of the second heat-sensitive paper roll hold portion 32-2, and this heat-sensitive paper roll support shaft 141 passes through and supports the core of the second heat-sensitive paper roll 210.

Figure 18:
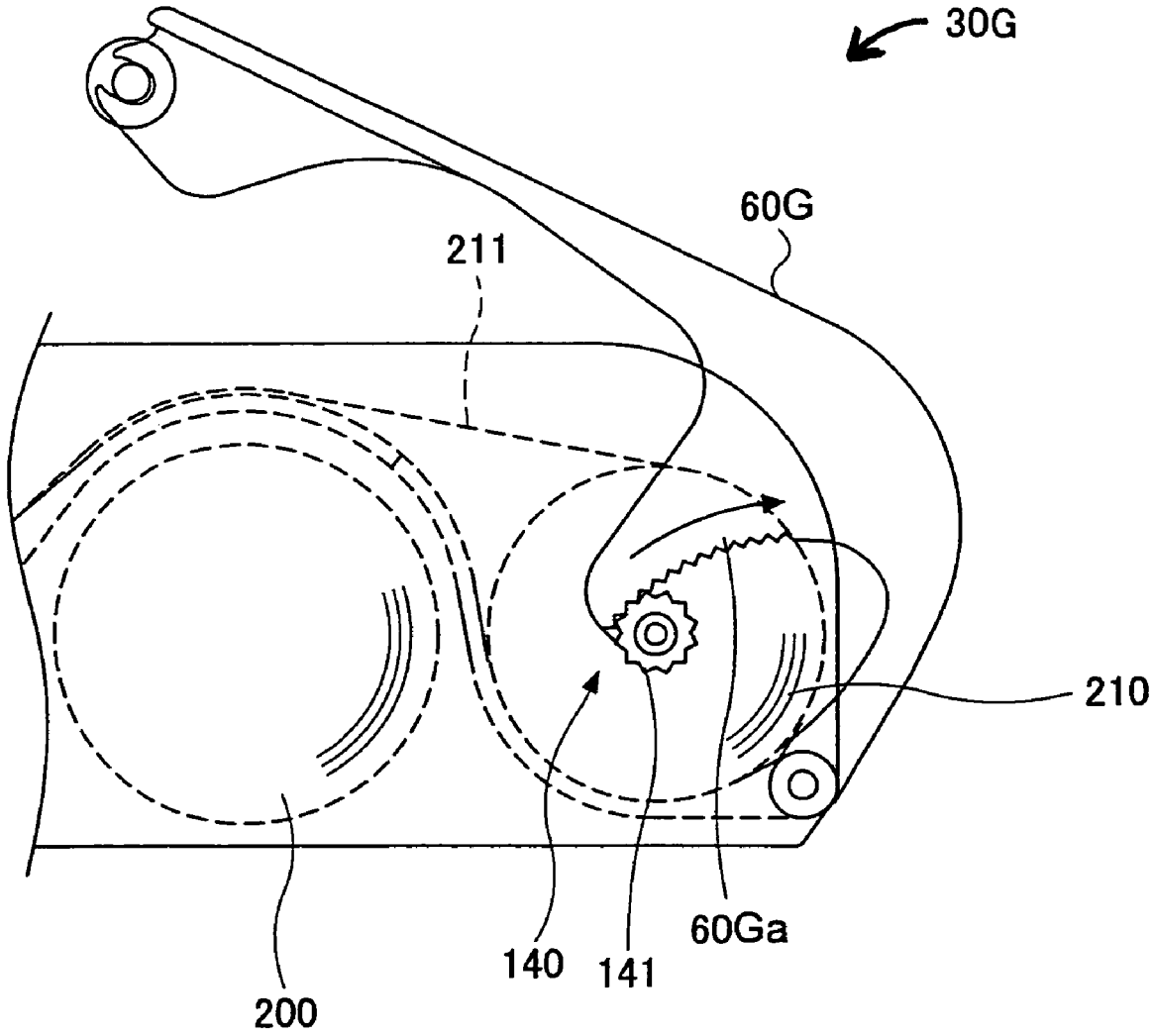
FIG. 18 is a diagram showing the condition of portable thermal printer device of FIG. 17A when the top cover is opened.

The internal-gear 60Ga is formed in the flange portion 60Gb of the top cover 60G along the circle centered around the shaft 51. FIG. 18 shows the condition of the portable thermal printer device of FIG. 17A when the top cover 60G is opened.

As shown in FIG. 18, in the manner interlocked with the operation of opening the top cover 60G, the heat-sensitive paper roll support shaft 141 is rotated clockwise, and the second heat-sensitive paper 211 is wound around the second heat-sensitive paper roll 210 so that the second heat-sensitive paper 211 is pulled back.

Moreover, in the manner interlocked with the operation of closing the top cover 60G, the heat-sensitive paper roll support shaft 141 is rotated counterclockwise, and the second heat-sensitive paper 30G is sent out from the second heat-sensitive paper roll 210.

Next, a description will be given of the ninth preferred embodiment of the invention.

Figure 19A:
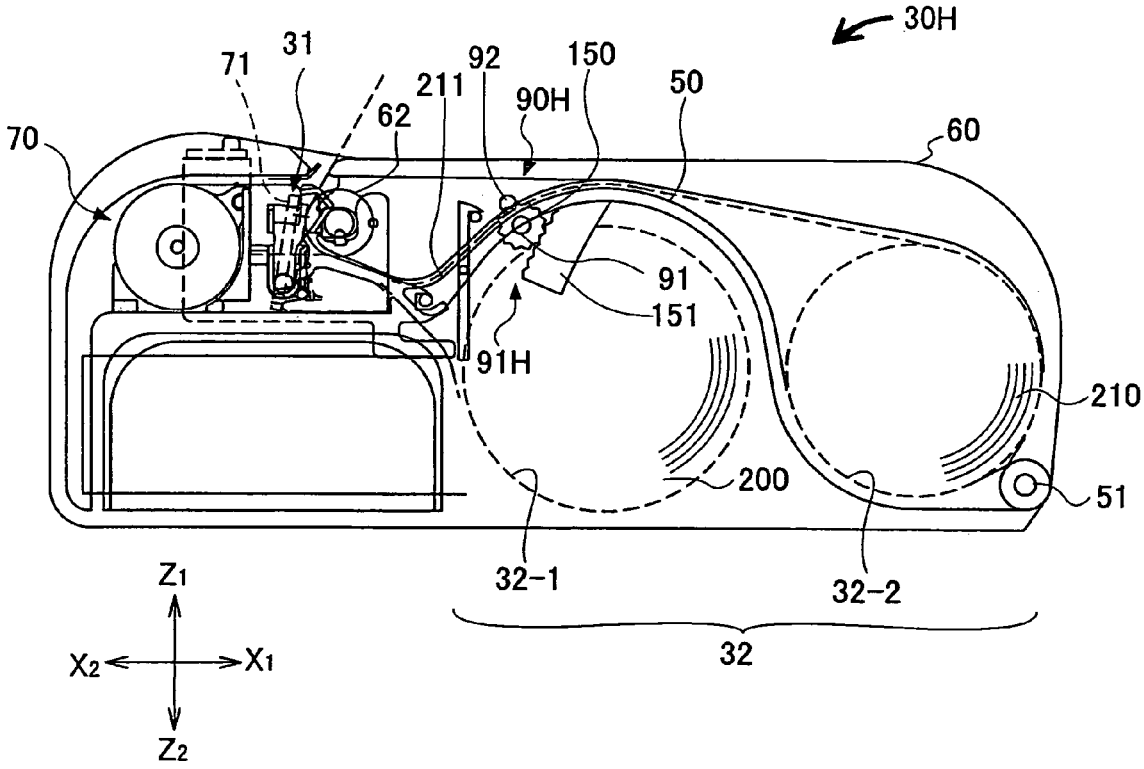
FIG. 19A and FIG. 19B are diagrams showing the portable thermal printer device in the ninth preferred embodiment of the invention.
Figure 19B:
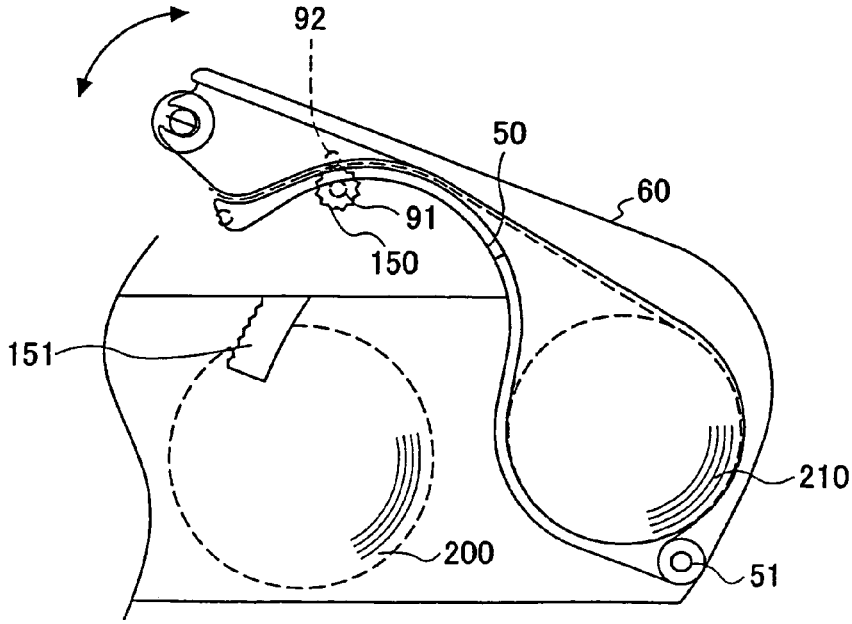

FIG. 19A and FIG. 19B show the portable thermal printer device 30H in the ninth preferred embodiment of the invention.

As shown in FIG. 19A, in the portable thermal printer device 30H of the present embodiment, the paper roll pull-back device 90 in the portable thermal printer device 30 of FIG. 3 is replaced with the paper roll pull-back/feed device 90H which is interlocked with the opening/closing operation of the top cover 60.

The paper roll pull-back/feed device 90H include the drive roller 91 attached to the middle cover 50, the pinch roller 92 attached to the top cover 60, the reduction gear 150 fixed to the end of the drive roller 91, and the rack portion 151 provided in the body 91H. The rack portion 151 is formed along the circle centered around the shaft 51. The reduction gear 150 is engaged with the rack portion 151.

As shown in FIG. 19A, in the manner interlocked with the operation of opening the top cover 60, the reduction gear 150 is rotated clockwise and moved along the rack portion 151. The second heat-sensitive paper 211 is pulled back by the drive roller 91 and the pinch roller 92 toward the direction of the second heat-sensitive paper roll hold portion 32-2.

The reduction gear 150 is rotated until it separates from the rack portion 151. The dimensions of the drive roller 91 and the reduction-gear 150 are predetermined so that the leading edge of the second heat-sensitive paper 211 pulled back is shifted to the X2-side position from the position of the drive roller 91. Namely, the second heat-sensitive paper 211 is still interposed between the drive roller 91 and the pinch roller 92 even when the pull-back operation is completed.

When the top cover 60 is closed, the reduction gear 150 in the final stage of the closing operation is engaged with the rack portion 151 and rotated counterclockwise so that the second heat-sensitive paper 211 is sent out toward the direction of the printing portion 31 by the drive roller 91 and the pinch roller 92.

The present invention is not limited to the above-described embodiments, and variations and modifications may be made without departing from the scope of the present invention. For example, the present invention is not limited to the thermal printer devices, and is also applicable to other printer devices using plain-paper rolls and so on.

What is claimed is:

1. A portable printer device in which a plurality of paper rolls are held, comprising:

a single printing portion provided for printing of each of the plurality of paper rolls;

a paper roll hold device including a plurality of paper roll hold portions each holding one of the plurality of paper rolls, and including a plurality of paper passages each provided to deliver a paper from one of the plurality of paper roll hold portions to the printing portion;

a paper pull-back device provided at one of the plurality of paper passages for pulling the paper from the printing portion back to one of the paper roll hold portions; and a cover, opening the cover being interlocked with operation of the paper pull-back device.

2. The portable printer device according to claim 1 further comprising:

a paper hold portion provided at the one of the plurality of paper passages between the paper pull-back device and the one of the paper roll hold portions for holding the paper by friction.

3. The portable printer device according to claim 1 further comprising a single paper outlet from which a printed paper from the printing portion is ejected, wherein the single paper outlet is provided for ejection of a printed paper from each of the plurality of paper rolls.

4. A portable printer device in which a plurality of paper rolls are held, comprising:

a body in which a single printing portion and a plurality of paper roll hold portions are provided, the single printing portion provided for printing of each of the plurality of paper rolls, each of the plurality of paper roll hold portions holding one of the plurality of paper rolls; and a plurality of covers supported on the body so that the plurality of covers are rotatable independently, the plurality of covers being provided so that the plurality of covers are opened separately and closed in an overlapped manner, all the plurality of paper roll hold portions being enclosed in the plurality of covers when all the plurality of covers are closed, wherein a plurality of paper passages are provided in respective spaces between the plurality of covers, each paper passage being provided to deliver a paper from one of the plurality of paper roll hold portions to the printing portion, and the plurality of covers are opened separately such that a predetermined one of the plurality of paper roll hold portions is selectively opened.

5. The portable printer device according to claim 4 further comprising a paper pull-back/feed device provided at one of the plurality of paper passages, the paper pull-back/feed device pulling the paper from the printing portion back to one of the paper roll hold portions, and delivering the paper from the one of the paper roll hold portions to the printing portion.

6. The portable printer device according to claim 5, wherein the paper pull-back/feed device is provided so that opening the cover is interlocked with operation of the paper pull-back/feed device pulling the paper from the printing portion back to the one of the paper roll hold portions, and closing the cover is interlocked with operation of the paper pull-back/feed device delivering the paper from the one of the paper roll hold portions to the printing portion.

7. A portable printer device in which a plurality of paper rolls are held, comprising:

a body in which a single printing portion and a first paper roll hold portion are provided, the single printing portion provided for printing of each of the plurality of paper rolls, the first paper roll hold portion holding one of the plurality of paper rolls; and a plurality of covers supported on the body so that the plurality of covers are independently rotatable around a common shaft on the body, the plurality of covers being provided so that the plurality of covers are opened separately and closed in an overlapped manner, wherein the first paper roll hold portion is enclosed in the plurality of covers when an innermost one of the plurality of covers is closed, others of the plurality of covers being provided so that a second paper roll hold portion between the other covers and a paper passage are provided when the other covers are closed in the overlapped manner, the paper passage provided to deliver a paper from the second paper roll hold portion to the printing portion, and the second paper roll hold portion being opened when the other covers are separated from each other.

* * * * *

UNITED STATES PATENT AND TRADEMARK OFFICE

CERTIFICATE OF CORRECTION

PATENT NO. : 7,125,181 B2
APPLICATION NO. : 10/913338
DATED : October 24, 2006
INVENTOR(S) : Yoshinari Takabatake et al.

It is certified that error appears in the above-identified patent and that said Letters Patent is hereby corrected as shown below:

On the Title page"

item (74) Attorney, Agent or Firm, col. 2, line 1, change "Hasley" to --Halsey--

Signed and Sealed this

Twentieth Day of March, 2007

JON W. DUDAS
*Director of the United States Patent and Trademark Office*